US007305981B1

(12) United States Patent
Lin

(10) Patent No.: US 7,305,981 B1
(45) Date of Patent: Dec. 11, 2007

(54) ANTI-RIOT DEVICE

(76) Inventor: Hsin-Hung Lin, No. 218, Changsing Rd., Luihu Township, Taoyuan County (TW)

( * ) Notice: Subject to any disclaimer, the term of this patent is extended or adjusted under 35 U.S.C. 154(b) by 0 days.

(21) Appl. No.: 11/451,453

(22) Filed: Jun. 13, 2006

(51) Int. Cl.
*F41B 11/26* (2006.01)

(52) U.S. Cl. ..... 124/59; 89/1.34

(58) Field of Classification Search ..... 89/1.34, 89/1.11; 124/57, 59, 63, 64
See application file for complete search history.

(56) References Cited

U.S. PATENT DOCUMENTS 3,349,514 A * 10/1967 Trechot ..... 43/60
4,912,869 A * 4/1990 Govett ..... 42/105
5,326,101 A * 7/1994 Fay ..... 463/47.4
5,460,155 A * 10/1995 Hobbs, II ..... 124/56
5,561,263 A * 10/1996 Baillod ..... 102/504
5,706,795 A * 1/1998 Gerwig ..... 124/71
5,750,918 A * 5/1998 Mangolds et al. ..... 102/502
5,814,754 A * 9/1998 Mangolds ..... 89/1.11
5,988,036 A * 11/1999 Mangolds et al. ..... 86/1.1
6,626,077 B1 * 9/2003 Gilbert ..... 89/1.11
6,904,838 B1 * 6/2005 Dindl ..... 89/1.1
2006/0086348 A1 * 4/2006 Song et al. ..... 124/56

* cited by examiner

*Primary Examiner*—Michael J. Carone
*Assistant Examiner*—Stewart T Knox
(74) *Attorney, Agent, or Firm*—Rosenberg, Klein & Lee

(57) ABSTRACT

An anti-riot device is provided that includes a net containing tube, and multiple shot holes in the upper area connecting with air outlet space. The shot holes are equidistantly spaced from the central axis of the device and are circumferentially angularly inclined. The lower side of the air outlet space communicates with a high pressure gas device. The net containing tube receives a high strength net body and a propellant board with a gas receiving concave shaped surface inside. Multiple bullets received in the shot holes are coupled to a periphery of the net body. The bottom of the net contained tube has multiple gas holes and an air outlet board.

2 Claims, 4 Drawing Sheets

ANTI-RIOT DEVICE

BACKGROUND OF THE INVENTION

1. Field of the Invention

The present invention relates to an improved anti-riot device. More particularly, the anti-riot device is designed with a net-type projectile structure and used for arresting criminals.

2. Description of the Related Art

While the police are in the process of arresting a criminal, if the police are confronted by the criminal, injury may result to the police on duty. Besides, there are many concerns for the police if they must use a gun. More particularly, they need to be aware of shooting a person in public areas as innocent people may be placed in danger. Therefore, the difficulty in arresting criminals alive is increased. In order to arrest a criminal alive, but without hurting innocent people, an anti-riot device can be used by the police, and an umbrella-shaped net is projected to arrest the criminal within a certain distance. Therefore, the police and the criminal will not get injured. Further, it is much more appropriate to use the anti-riot device in public areas.

The anti-riot device (10), referring to FIG. 1, mainly comprises a projectile (101), a net containing tube (102) in the center, and multiple gas holes (102*a*) in the bottom. The projectile (101) has multiple shot holes (101*a*). The shot holes (101*a*) are connected with the air outlet space (103). The lower side of the air outlet space (103) has a high pressure gas device (104). The main feature of the structure is that the multiple shot holes (101*a*) are inclined outwardly from a central axis of the projectile (101). The net containing tube (102) has a propellant board (105*a*) and a high strength net body (105) positioned therein. The outer area of the high strength net body (105) has multiple bullets (106) disposed in the shot holes (101*a*). While arresting a criminal, the user can initiate the high pressure gas device (104), and the strong pressure is released to the gas holes (102*a*) and the shot holes (101*a*) in the bottom of the net containing tube (102) through air outlet space (103). The strong pressure propels the bullets (106), the propellant board (105*a*) and the high strength net body (105).

By the arrangement described above, the high strength net body (105) is opened into an umbrella shape while being propelled for arresting the criminal, because the shot holes (101*a*) are inclined outwardly from the central axis of the projectile (101). However, since the shot holes (101*a*) are outwardly inclined from the central axis of the projectile (101), the projectile (101) requires a large volume, which is not convenient to be carried, as shown in FIG. 2. Further, the propellant board (105*a*) is positioned in the bottom of the net containing tube (102) for assisting the high strength net body (105) to be propelled by the pressurized gas. However, the propellant board (105*a*) is a disk shape, and it can not uniformly distribute the concentrated pressure of the propelling gas and causes an an uneven propulsion of the high strength net body.

SUMMARY OF THE INVENTION

The present invention relates to an improved anti-riot device. More particularly, the anti-riot device of the present invention comprises a net containing tube, and multiple shot holes in the upper area connecting with air outlet space. The lower side of the air outlet space communicates with a high pressure gas device. Further, the net containing tube has a high strength net body and a propellant board with a gas receiving concave shaped surface. The outer area of the net body has multiple bullets disposed in shot holes.

The bottom of the net contained tube has multiple gas holes and an air outlet board.

DETAILED DESCRIPTION OF THE INVENTION

Figure 3:
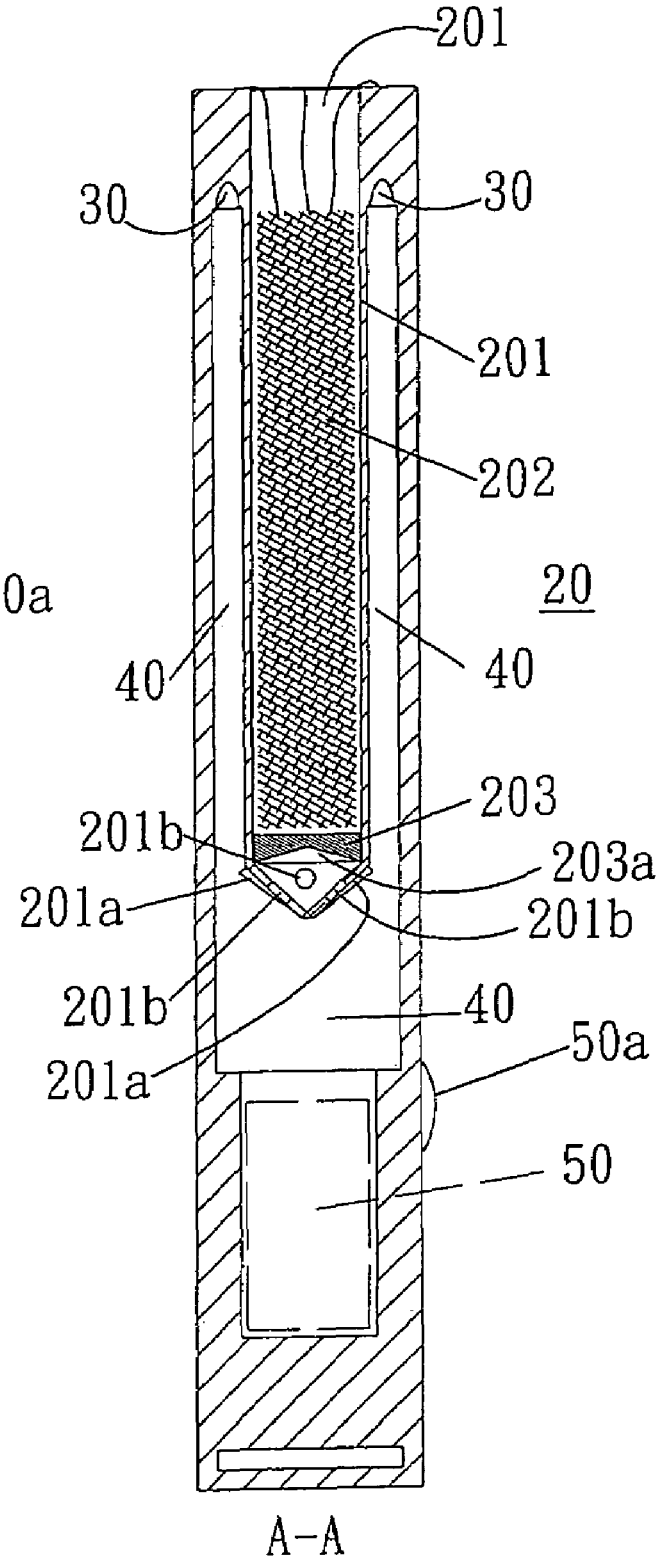
FIG. 3 is one example of the present invention showing an improved anti-riot device by an A-A cross-sectional view.
Figure 5:
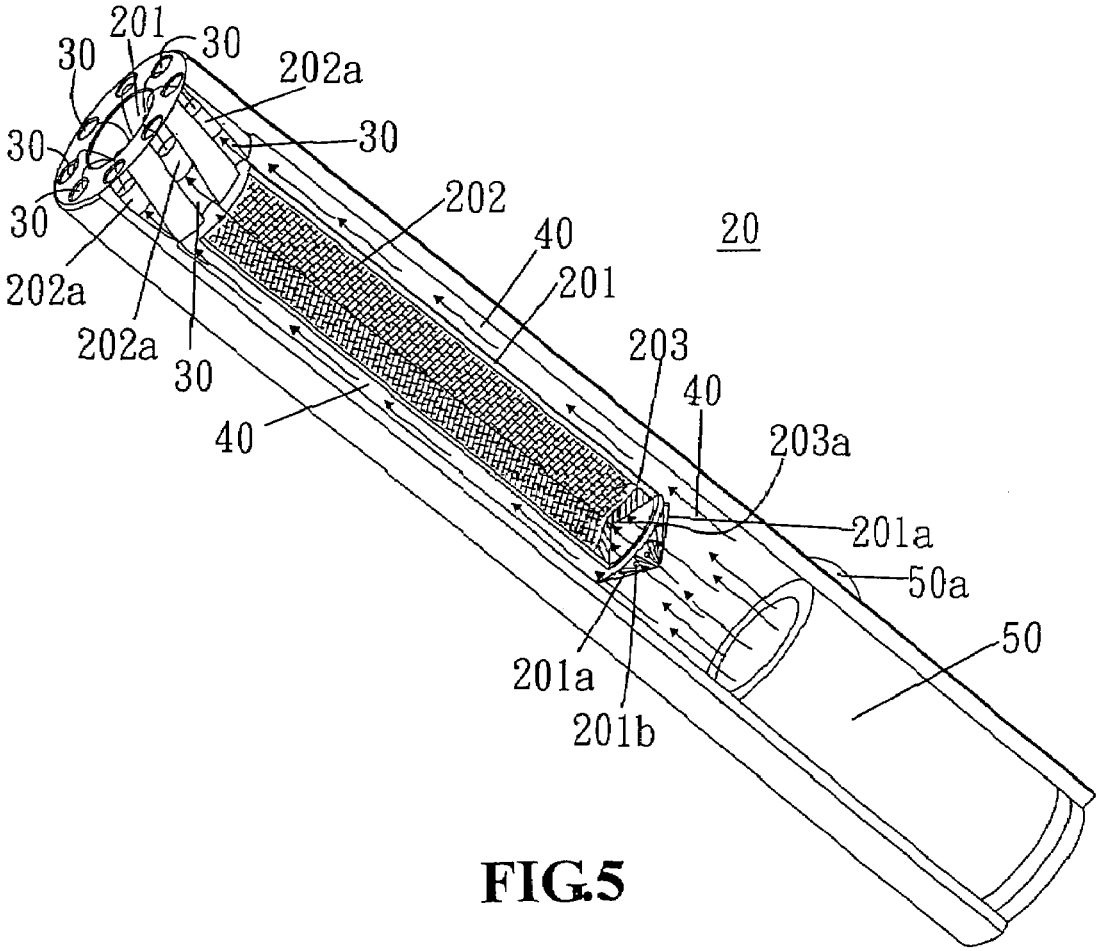
FIG. 5 is one example of the present invention showing an improved anti-riot device by a partial 3-Dimensional view.

FIG. 3 and FIG. 5 of the present invention show an improved anti-riot device (20) by an cross-sectional view A-A and a partial 3-Dimensional view. As shown in the figures, the center in the front of the anti-riot device (20) has a net containing tube (201), and the bottom of the anti-riot device (20) has an air outlet board (201*a*) with multiple gas holes (201*b*).

Figure 1:
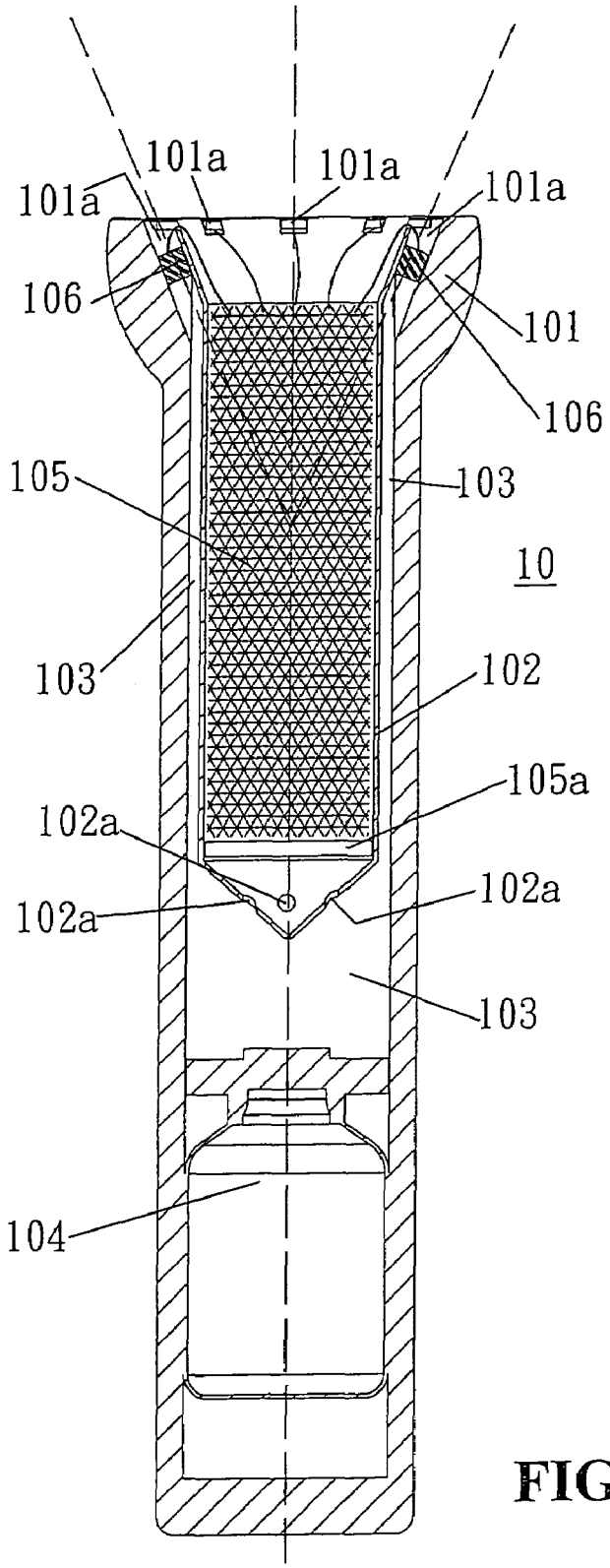
FIG.1 (PRIOR ART )
FIG. 1 is a cross-sectional view showing an anti-riot device according to the prior art.
Figure 2:
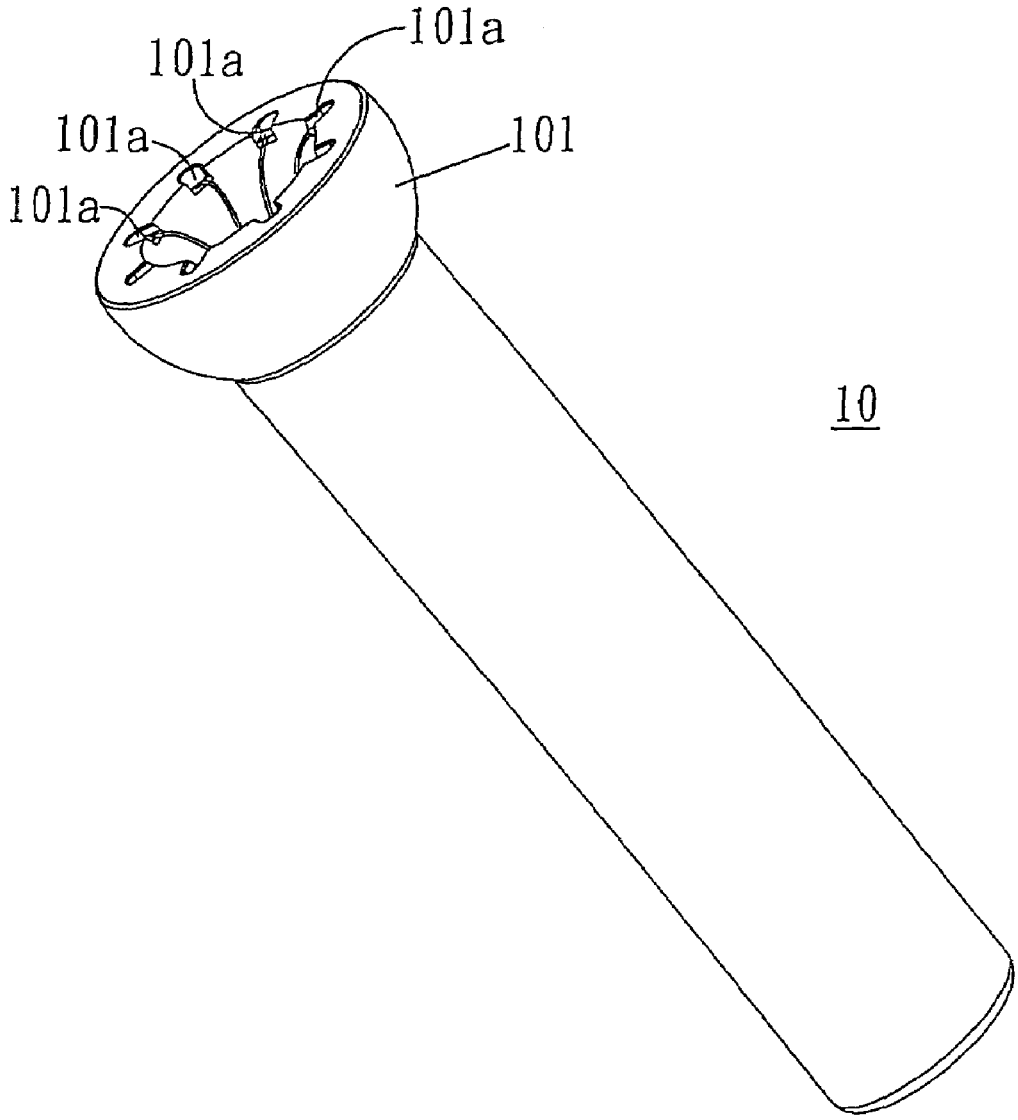
FIG.2 (PRIOR ART )
FIG. 2 is a 3-Dimensional view showing an anti-riot device according to the prior art.
Figure 4:
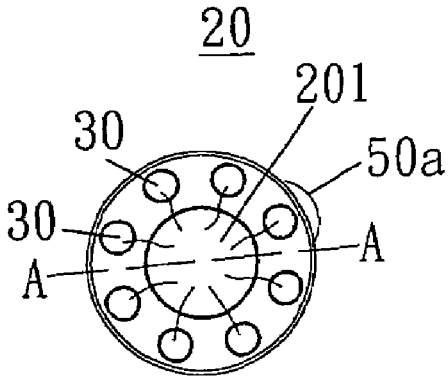
FIG. 4 is one example of the present invention showing an improved anti-riot device by a top view.

Referring to to FIGS. 4 and 5, the upper area has multiple shot holes (30) that are equidistantly spaced from the central axis of the device and have a circumferential angular inclination where the top end of the shot holes (30) are angularly offset with respect to a bottom end of the shot holes (30). The shot holes (30) are connected with the air outlet space (40). The lower side of the air outlet space (40) has a high pressure gas device (50). The net containing tube (201) receives a high strength net body (202) and a propellant board (203) with a gas receiving concave shaped surface (203*a*) inside the tube. Further, the bullets (202*a*) are coupled to the outer periphery of the net body (202) and are positioned in the shot holes (30).

The high pressure gas device (50) is initiated by an electrical launcher (50*a*) and releases the pressurized gas. Then, the pressurized gas enters the net containing tube (201) through the air outlet space (40) and gas holes (201*b*) for propelling the propellant board (203). The gas receiving concave shaped surface (203*a*) of the propellant board (203) concentrates the pressure to propel the bullets of the net body (202) out. The net body (202), therefore, can quickly be opened into an umbrella shape.

The net body (202) is projected into an umbrella shape. Since the bullets (202*a*) coupled to the outer area of the net body (202) are propelled by a strong pressure, the bullets (202*a*) being propelled at a projected angle corresponding to the inclination angle of the shot holes (30) make the net body (202) open quickly for arresting a criminal. As described above, the structure of the present invention achieves the objectives of a reduced volume that is convenient to carry. Further, the structure is simple.

The above embodiments are only used to illustrate the present invention, and not intended to limit the scope thereof. Many modifications of the above embodiments can be made without departing from the spirit of the present invention.

What is claimed is:

1. An improved anti-riot device, comprising:

a high pressure gas storage device disposed at a lower portion of the device and being in fluid communication with an air outlet space;

a net containing tube disposed in a front portion of the device;

an air outlet board having multiple gas holes formed therethrough being disposed a lower end of the net containing tube, the gas holes being in fluid communication with the air outlet space;

multiple shot holes circumferentially disposed around an upper end of the net containing tube and in fluid communication with the air outlet space, each of the shot holes having upper and lower ends equidistantly spaced from a central axis of the device and angularly offset one from the other to define a circumferential angular inclination;

a net body having a plurality of bullets coupled to an outer periphery thereof, the net body being disposed in the net containing tube with the plurality of bullets respectively disposed in the shot holes; and a propellant board having a gas receiving concave surface disposed in the net containing tube and positioned between the air outlet board and net body, the gas receiving concave surface of the propellant board concentrating gas pressure to propel the bullets of the net body from the shot holes and thereby quickly deploy the net body into an umbrella shape as it is projected from the net containing tube responsive to release of high pressure gas from the high pressure gas storage device.

2. An improved anti-riot device according to claim 1, further comprising an electrical launcher for initiating release of the high pressure gas from the high pressure gas storage device.

* * * * *